US008878638B2

(12) United States Patent
Bertacco et al.

(10) Patent No.: US 8,878,638 B2
(45) Date of Patent: Nov. 4, 2014

(54) MANIPULATION OF MAGNETIC PARTICLES IN CONDUITS FOR THE PROPAGATION OF DOMAIN WALLS

(75) Inventors: Ricardo Bertacco, Morazzone (IT); Matteo Cantoni, Bresso (IT); Marco Donolato, Milan (IT); Marco Gobbi, Lody (IT); Stefano Brivio, Seregno (IT); Paolo Vavassori, San Sebastian (ES); Daniela Petti, Milan (IT)

(73) Assignee: Asociacion-Centro de Investigacion Cooperativa en Nanociencias-CIC Nanogune, San Sabastian-Donostia (ES)

( * ) Notice: Subject to any disclaimer, the term of this patent is extended or adjusted under 35 U.S.C. 154(b) by 432 days.

(21) Appl. No.: 13/148,649

(22) PCT Filed: Feb. 12, 2010

(86) PCT No.: PCT/EP2010/000879

§ 371 (c)(1),
(2), (4) Date: Oct. 11, 2011

(87) PCT Pub. No.: WO2010/091874

PCT Pub. Date: Aug. 19, 2010

(65) Prior Publication Data

US 2012/0037236 A1 Feb. 16, 2012

(30) Foreign Application Priority Data

Feb. 12, 2009 (IT) ..... VI2009A0026

(51) Int. Cl.
*H01F 7/20* (2006.01)
*H01F 13/00* (2006.01)
*B03C 1/32* (2006.01)

(52) U.S. Cl.
CPC ..... *B03C 1/32* (2013.01); *B03C 2201/18* (2013.01)
USPC ..... 335/284; 335/296; 335/302; 335/306; 365/173

(58) Field of Classification Search
USPC ..... 335/284–306; 365/173
See application file for complete search history.

(56) References Cited

U.S. PATENT DOCUMENTS 2,984,825 A 5/1961 Fuller et al.
3,440,623 A 4/1969 Chang et al.

(Continued)

FOREIGN PATENT DOCUMENTS

GB 989749 4/1965
GB 1095431 12/1967
IT TO 2008 A 000314 4/2008

OTHER PUBLICATIONS

Helseth et al, Domain Wall Tip for Manipulation of Magnetic Particles, Physical Review Letters, vol. 91, No. 20, 208302-1-4, 2003.

(Continued)

*Primary Examiner* — Mohamad Musleh
(74) *Attorney, Agent, or Firm* — Fattibene and Fattibene LLC; Paul A. Fattibene

(57) ABSTRACT

A system and a method for the controlled manipulation of any number of magnetic particles in solution are shown. The system and the method of the present invention are based on the employment of magnetic conduits properly structured in order to inject, move and annihilate with high precision magnetic domain walls and on the fact that said magnetic domain walls exert a high attraction force on magnetic particles. The injection, movement and annihilation of domain walls along said magnetic conduit result, therefore, in the trapping, movement and release, respectively, of single magnetic particles placed in solution in proximity of said magnetic conduits. The devices of the present invention guarantee the possibility of a digital transfer of magnetic particles along conduits formed by linear segments as well as high control and nanometric precision in the manipulation of said magnetic particles on curved conduits.

11 Claims, 11 Drawing Sheets

(56) References Cited

U.S. PATENT DOCUMENTS

| | | | | |
|---|---|---|---|---|
| 3,493,940 | A | 2/1970 | Shafer | |
| 3,508,215 | A | 4/1970 | Cohler et al. | |
| 4,974,200 | A | 11/1990 | Ono et al. | 365/29 |
| 5,893,206 | A * | 4/1999 | Furlani et al. | 29/608 |
| 7,267,999 | B2 * | 9/2007 | Drewes | 438/3 |
| 7,667,562 | B1 * | 2/2010 | Weinstein | 335/216 |
| 7,692,180 | B2 * | 4/2010 | Snyder et al. | 257/14 |
| 2004/0251232 | A1 * | 12/2004 | Chen et al. | 216/22 |
| 2004/0262210 | A1 * | 12/2004 | Westervelt et al. | 210/222 |
| 2005/0078511 | A1 * | 4/2005 | Parkin | 365/171 |
| 2006/0120132 | A1 * | 6/2006 | Parkin | 365/80 |
| 2007/0228439 | A1 * | 10/2007 | Duan et al. | 257/296 |
| 2008/0080222 | A1 | 4/2008 | Fisher et al. | 365/32 |
| 2011/0037463 | A1 * | 2/2011 | Bertacco et al. | 324/244 |
| 2011/0124077 | A1 | 5/2011 | Sooryakumar et al. | 435/173.9 |

OTHER PUBLICATIONS

Conroy et al, Controlled transport of magnetic particles using soft magnetic patterns, Applied Physics Letters, 93, 203901-1-3, 2008.

Gunnarsson et al, Programmable Motion and Separation of Single Magnetic Particles on Patterned Magnetic Surfaces, Advanced Materials, 17, 1730-1734, 2005.

Vavassori et al, Metastable states during magnetization reversal in square permalloy rings, Physical Review B, 67, 134429-1-7, 2003.

Vavassori et al, Domain wall displacement in Py square ring for single nanometric magnetic bead detection, Applied Physics Letters, 93, 203502-1-3, 2008.

Allwood et al, Submicrometer Ferromagnetic NOT Gate and Shift Register, Science, vol. 296, 2003-2006, 2002.

Helseth et al., Microscopic magnetic squeezer, Applied Physics Letters, vol. 85, No. 13, pp. 2556-2558, Sep. 27, 2004.

Helseth et al., Paramagnetic beads surfing on domain walls, Physical Review, E 67, 042401, pp. 1-4, 2003.

* cited by examiner

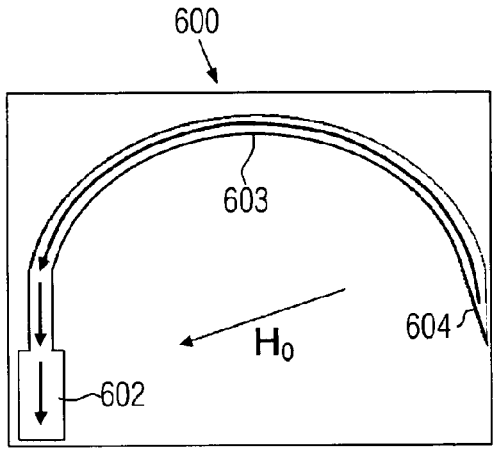
FIG. 12a
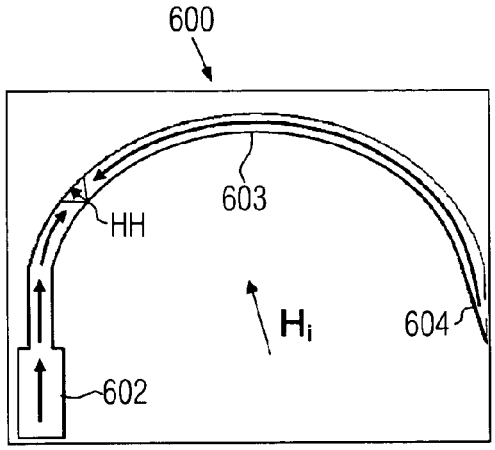
FIG. 12b
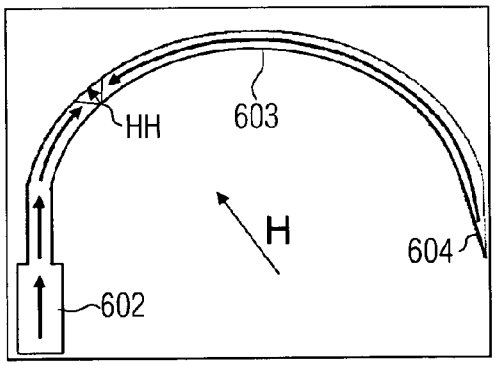
FIG. 12c
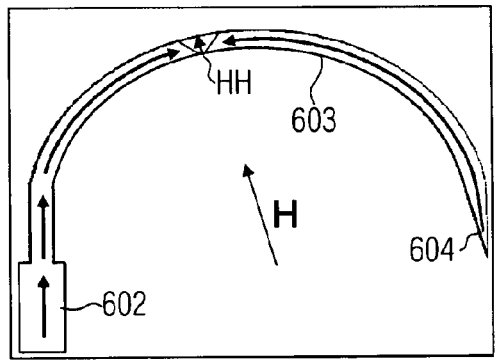
FIG. 12d
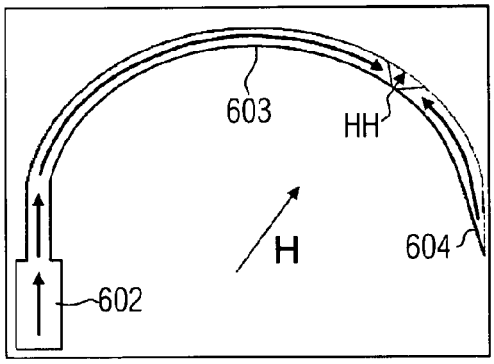
FIG. 12e
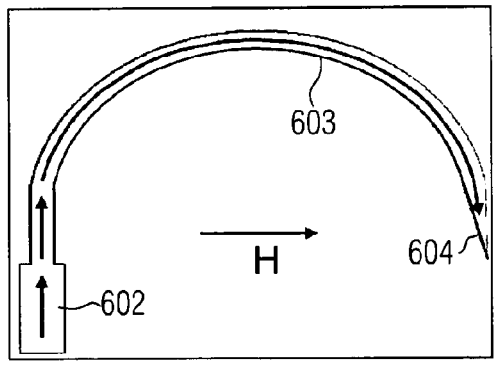
FIG. 12f
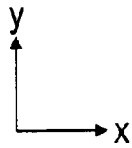

MANIPULATION OF MAGNETIC PARTICLES IN CONDUITS FOR THE PROPAGATION OF DOMAIN WALLS

FIELD OF THE PRESENT INVENTION

The present invention relates to the field of the manipulation of magnetic particles in suspension. In particular, the present invention relates to the field of the manipulation of magnetic particles by means of the propagation of domain walls. Still more in particular, the present invention relates to the field of the manipulation of magnetic particles by means of the creation, propagation and annihilation of domain walls within magnetic material conduits properly structured.

STATE OF THE ART

Controlled manipulation of particles is one of the main objects of nanotechnologies. The ability of driving nanoparticles in suspension with nanometric precision plays a primary role in several fields of science and engineering such as chemistry, physics, material science, biotechnology and medicine. In particular, in the chemical, biological and medical fields, the possibility of realizing miniaturized devices down to the nanometric scale and able to perform chemical and biological analysis or synthesis on small sample quantities introduced by microfluidic means is of relevant interest. In general this kind of approach is defined "lab on a chip" suggesting the execution of operations typical of any scientific laboratory at the microscopic level, i.e. in a "laboratory" having the dimensions of a microchip. Within this sector, one of the most promising fields concerns the controlled manipulation of magnetic particles in solution. Magnetic particles play, in fact, a particularly important role for their employment in biochemical and medical diagnostic applications. By properly functionalizing their surfaces, it is in fact possible to employ magnetic particles as carriers for transporting or separating biological entities thanks to the action of the magnetic forces on the particles or as molecular markers for a detection based on the magnetic properties of the particles themselves.

Several lab on a chip systems for the manipulation of magnetic particles are based on complex devices which may comprise several kinds of micro-valves and micro-pumps for the realization of structures for the controlled transport of fluids comprising magnetic particles in solution. These systems, besides being complex and, therefore, expensive to design and to realize, require also the employment of external apparatuses which significantly increase the overall dimensions of the system.

On the contrary, there is the possibility of directly moving the magnetic particles independently from the motion of the fluids inside which they are dispersed.

One of the approaches employed for the manipulation of magnetic particles is based on the interactions between said particles and a magnetic substrate, in particular a magnetized substrate.

The idea at the base of this approach is that of operating on the magnetic configuration of the substrate modifying it so that the magnetic particles react to this modification in a controlled and predictable manner, although the controllability and predictability so far achieved are very limited. In general, however, the systems known in the literature are based on magnetic devices based on macroscopic permanent magnets or driven by external magnetic fields and by high electric currents which must be carried by appropriate electric circuits being generally difficult to design and to realize. The systems based on the passage of electric currents are difficult to employ in wet reaction environments, in particular in the presence of solutions, and accordingly require thorough care in order to isolate the electric contacts from the magnetic particles solutions.

Moreover, further to eddy currents generation phenomena and, in general, to electronic noise, the systems based on the passage of electric currents do not allow the miniaturization of the devices and the creation of systems with high density of devices and high parallelization level.

One of the typical problems concerning the systems for the controlled manipulation of magnetic particles concerns, moreover, the spatial resolution that can be achieved. In particular, the systems known in the literature allow the control of the motion of magnetic particles with a precision in the order of some micrometers, while it would be desirable to be able to achieve a much more precise control, ideally in the range of nanometers.

A further problem concerning the devices as known in the literature relates to the difficulty of precisely manipulate single magnetic particles. In general, the devices known in the literature allow the motion of groups of particles, and they do not allow the management of the motion of single particles.

In PRE 67, 042401 (2003), the authors describe a magnetic particles movement modality driven by a very wide Bloch domain wall on a gadolinium garnet film surface. Because of the geometry of the system, a very high and uncontrolled number of magnetic particles is displaced following the displacement of the domain wall. Accordingly, the system described in PRE 67, 042401 (2003), is inadequate for the controlled displacement of single magnetic particles.

In PRL 91, 208302 (2003), a tip-shaped domain wall on a surface of a magnetic film is employed. Displacing this tip-shaped domain wall by means of external fields, superparamagnetic particles in interaction with the high field coming out from the tip of the domain wall are displaced. The mechanism for the creation of the tip-shaped magnetic domain described in PRL 91, 208302 (2003) is extremely complex and the exact position where the tip is forming is hard to control. Moreover, the displacements obtained are up to 100 micrometers with a precision in the order of one micrometer.

In Appl. Phys. Lett. 93, 203901(2008), and in Adv. Mater. 17, 1730 (2005), the displacement of magnetic particles driven by the combined action of rotating magnetic fields and ferromagnetic structures is described. An external magnetic field is focused on several points of the lithographed magnetic structures during the rotation of the field and the special shape and disposition of the structures allow the magnetic particles to follow these points in an advancing collective motion along a particular direction. Nevertheless, the scale on which the displacements are considered is in the range of some microns or some tens of microns with low resolution. Moreover, it is not possible to obtain a precise control on the motion of the particles, nor on their number, during the displacement of same. Finally, the systems described in these documents imply the presence of permanent external magnetic fields.

In the US Patent Application No. 2008/0080222 A1 a system for the digital displacement of paramagnetic particles jumping from a domain wall to another one in a continuous film of a magnetic garnet is described. Two different configurations are shown: the creation of alternate stripes domains with Bloch domains walls and the creation of magnetic bubbles. The displacement of the magnetic particles is activated by means of external magnetic fields which vary the disposition of the domain walls or of the magnetic bubbles so as to create a preferential direction of displacement. The systems described in US 2008/0080222 A1 allow accordingly the realization of the displacement of groups of particles and do not allow the control on the motion of the single particles. Also in this case, the exact disposition of the domain walls is not controllable.

SCOPE OF THE INVENTION

In the light of the problems and drawbacks concerning the controlled manipulation of magnetic particles mentioned above, scope of the present invention is that of providing a system and a method for the manipulation of magnetic particles allowing the overcoming of said problems.

In particular, scope of the present invention is that of providing a system and method for the manipulation of magnetic particles in suspension allowing the controlled manipulation of any well defined number of magnetic particles, even of a single one. Moreover, scope of the present invention is that of providing a system and a method for the manipulation of magnetic particles allowing the achievement of a control on the position of the single magnetic particles with a precision in the order of 10-100 nanometers. Moreover, scope of the present invention is that of providing a system easy to design and to realize and easy to be employed in a miniaturized platform. A further scope of the present invention is that of providing a system and a method allowing the manipulation of several molecules attached to magnetic particles so as to promote interactions and selective reactions between the molecules. Further scope of the present invention is that of providing a system and a method wherein the controlled manipulation of magnetic particles do not require the presence of permanent external fields. Further scope of the present invention is that of providing a system allowing the controlled manipulation of magnetic particles in solution without employing mechanical elements such as pumps, syringes and valves.

SUMMARY

The present invention relates to a system and a method for the controlled manipulation of magnetic particles. The present invention is based on the general idea of combining the extremely precise and controlled motion of magnetic domain walls within magnetic conduits properly structured with the effective interaction that establishes between said magnetic domain walls and single magnetic particles.

According to a particularly advantageous embodiment of the present invention, a device for the controlled manipulation of magnetic particles is provided comprising a substrate, a magnetic conduit suitable for the creation, movement and annihilation of domain walls and a magnetic particles solution placed in proximity of the surface of said magnetic conduit, wherein said magnetic conduit comprises a strip of magnetic material so that said magnetic particles can be trapped, moved and released along said strip as a consequence of the creation, movement and annihilation of said domain walls along said strip and of the interaction between said domain walls and said magnetic particles.

According to a further embodiment of the present invention, a device for the controlled manipulation of magnetic particles is provided comprising a strip of magnetic material comprising a plurality of adjacent segments wherein the length of said segments is substantially larger than the transversal dimensions (width and thickness) of said segments so that the domain walls are transversally placed with respect to said strip and maintain their integrity during the movement.

According to a further embodiment of the present invention, a device for the controlled manipulation of magnetic particles is provided comprising a strip of magnetic material comprising a plurality of adjacent segments wherein said plurality of adjacent segments comprise a plurality of rectilinear segments so that the displacement of magnetic particles along the rectilinear segments is a digital displacement.

According to a further embodiment of the present invention, a device for the controlled manipulation of magnetic particles is provided comprising a magnetic material strip comprising a plurality of adjacent segments wherein said plurality of adjacent segments comprise a plurality of curved segments so that the displacement of the magnetic particles along the curved segment is a continuous displacement.

According to a further embodiment of the present invention, a device for the controlled manipulation of magnetic particles is provided comprising a magnetic material strip comprising a plurality of adjacent segments wherein said plurality of adjacent segments comprises both a multiplicity of rectilinear segments so that the displacement of the magnetic particles along the rectilinear segments is a digital displacement, and a multiplicity of curved segments so that the displacement of the magnetic particles along the curved segments is a continuous displacement.

According to a further embodiment of the present invention, a device for the controlled manipulation of magnetic particles is provided comprising a magnetic conduit comprising a square ring of magnetic material.

According to a further embodiment of the present invention, a device for the controlled manipulation of magnetic particles is provided comprising a magnetic conduit comprising an injector for the injection of domain walls, a plurality of adjacent rectilinear segments forming a zigzag structure for the digital controlled displacement of said domain walls and a termination for the annihilation of said domain walls.

According to a particularly advantageous embodiment of the present invention, a device for the controlled manipulation of magnetic particles is provided comprising a magnetic conduit comprising a modified zigzag structure comprising pairs of slanting segments placed so as to form an angle $2\alpha$ alternated with horizontal segments for the controlled digital displacement of said domain walls.

According to a further embodiment of the present invention, a device for the controlled manipulation of magnetic particles is provided comprising a magnetic conduit comprising a circular ring of magnetic material so that the displacement of the domain walls along the circular ring is a continuous controlled movement.

According to a further embodiment of the present invention, a device for the controlled manipulation of magnetic particles is provided comprising a magnetic conduit comprising an injector for the injection of domain walls, a curved structure for the controlled and continuous movement of said domain walls and a termination for the annihilation of said domain walls.

According to particular embodiments of the present invention, a device for the controlled manipulation of magnetic particles is provided comprising a magnetic conduit comprising at least a bifurcation splitting said magnetic conduits in two or more different branches.

According to a particular embodiment of the present invention, a device for the controlled manipulation of magnetic particles is provided comprising at least a sensor for detecting domain walls and/or magnetic particles.

According to a particularly advantageous embodiment of the present invention, an apparatus for the controlled manipulation of magnetic particles is provided comprising a device for the controlled manipulation of magnetic particles according to the present invention and means for the generation, the movement and the annihilation of domain walls in a magnetic conduit.

According to a particularly advantageous embodiment of the present invention, a method for the controlled manipulation of magnetic particles is provided comprising the following steps: deposition of a solution of magnetic particles in proximity of the surface of a magnetic conduit suitable for the creation, movement and annihilation of domain walls and comprising a magnetic material strip; trapping of at least one of said magnetic particles along said strip by means of the creation of at least a domain wall along said strip.

According to a particularly advantageous embodiment of the present invention, a method for the controlled manipulation of magnetic particles is provided comprising the step of moving said trapped particle by means of the controlled movement of at least a domain wall along the magnetic material strip.

According to a particular embodiment of the present invention, a method for the controlled manipulation of magnetic particles is provided comprising the step of releasing said trapped magnetic particle by means of the annihilation of at least a domain wall along the magnetic material strip.

According to a further embodiment of the present invention, a method for the controlled manipulation of magnetic particles is provided comprising the step of functionalizing at least a magnetic particle by means of adhesive substances or of surface reactive groups so that said magnetic particle can be bound to at least one non-magnetic molecule.

BRIEF DESCRIPTION OF THE DRAWINGS

FIG. 12 schematically displays the creation, propagation and annihilation of a domain wall HH in a conduit having curved shape according to a particular embodiment of the present invention.

In the enclosed Figures, identical or corresponding parts are identified by the same reference numbers.

DETAILED DESCRIPTION

In the following, the present invention is described with reference to particular embodiments as shown in the enclosed drawings. Nevertheless the present invention is not limited to the embodiments described in the following detailed description and shown in the Figures, but rather these embodiments exemplify various aspects of the present invention the scope of which is defined by the claims.

Further modifications and variations of the present invention will be clear for the person skilled in the art. The present invention has to be accordingly considered as comprising all said modification and/or variations of the present invention, the scope of which is defined by the claims.

A domain wall is an interface region between two magnetic domains, i.e. between two regions of a material with different uniform magnetizations. With reference to a planar structure on a substrate, it is possible to define Bloch domain walls and Néel domain walls according to whether the magnetization exhibits or not a component outside the plane. In the following, reference will be made to structures with Néel walls, but the concept of the present invention can be extended to the case of Bloch walls.

In particular, the concept of the present invention exploits domain walls in strips of ferromagnetic material, where shape anisotropy restricts the magnetization to lie parallel to the strip axis. In such a strip, a domain wall is a mobile interface, which separates regions of oppositely aligned magnetization. Due to the geometrical confinement, the spin structure of a domain wall can be controlled via the lateral dimensions and film thickness of the strip and its length is determined by the strip width. For this reason such domain walls are called constrained domain walls and under particular conditions, which are those implemented in the concept of the present invention, these domain walls can be manipulated within the strip without change of the spin structure of the domain wall itself. This property is a peculiarity of the strip geometry considered in the concept of the present invention and differs substantially from previous cases in which domain walls in extended bi- and tri-dimensional systems (films and multilayers), where neither their number nor their length and manipulation can be controlled, have been used for both different and similar purposes.

Figure 1A:
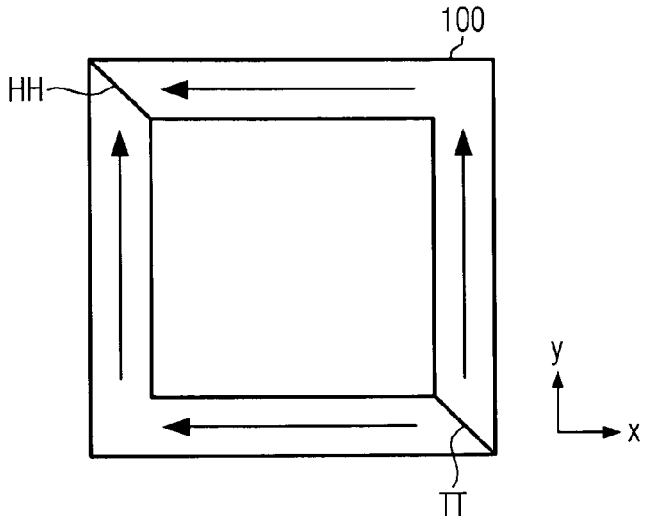
FIG. 1*a* schematically displays a square shaped ring made of magnetic material inside which two domain walls are present.

FIG. 1*a* schematically displays two domain walls in a ring structure 100 having a square shape. The vertical sides of the ring 100 shown in FIG. 1*a* display uniform magnetization directed along the positive direction of the y axis of the frame of reference x-y shown in the Figure, while the horizontal sides display uniform magnetization directed along the negative direction of the axis x. In this way, two domain walls HH and TT are visible in the upper left corner and in the lower right corner, respectively, of the square ring 100. The domain wall in the upper left corner of the square ring is indicated with HH ("Head to Head") since it consists of an interface between two magnetic domains whose magnetizations are both directed toward the domain wall itself. On the contrary, the domain wall in the lower right corner is indicated with TT ("Tail to Tail") because it consists of an interface between two magnetic domains whose magnetizations are both outwardly directed with respect to the domain wall itself.

Figure 1B:
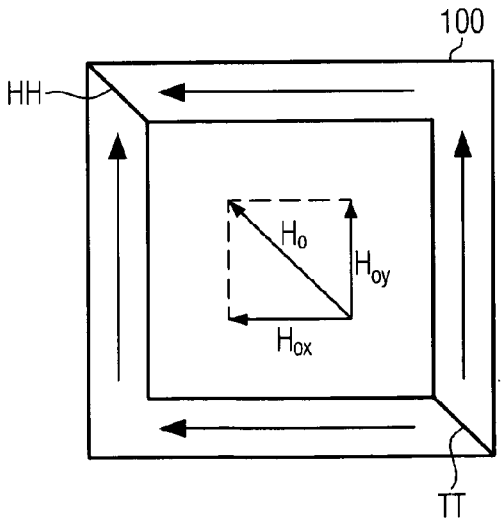
FIG. 1*b* schematically displays the principle at the basis of the creation of domain walls in a system similar to the one shown in FIG. 1*a*.

FIG. 1*b* schematically displays the principles at the base of the creation of two domain walls HH, TT in a square ring structure 100 as shown in FIG. 1*a*. Typically, a structure of this kind may be realized with ferromagnetic materials at room temperature. Non exhaustive examples of said materials are iron, nickel, cobalt, permalloy (nickel-iron alloy), magnetic oxides, manganites, Heussler alloys, magnetite. The structures shown in the present disclosure have been obtained with permalloy, but this has not to be understood as restrictive for the field of application of the present invention. Applying to the square ring structure 100 an external magnetic field $H_0$ directed along the diagonal of the square connecting the lower right vertex with the upper left vertex of the square, a uniform magnetization is induced in the sides of the square as described in FIG. 1*a*. In particular, the field $H_0$ has a negative component $H_{0x}$ and a positive component $H_{0y}$. The component $H_{0x}$ determines the uniform magnetization in the horizontal sides of the square ring 100 while the component $H_{0y}$ determines the uniform magnetization in the vertical sides of said ring. The application of the external field $H_0$ results, therefore, in the creation of the domain walls HH and TT in the upper left vertex and in the lower right vertex respectively of the square ring 100. Since the magnetization of the sides of the ring 100, once acquired, is stable even in the absence of the external field $H_0$, the configuration shown in FIG. 1*b* remains unaltered even removing said external field, and the domain walls HH and TT are stable.

Figure 1C:
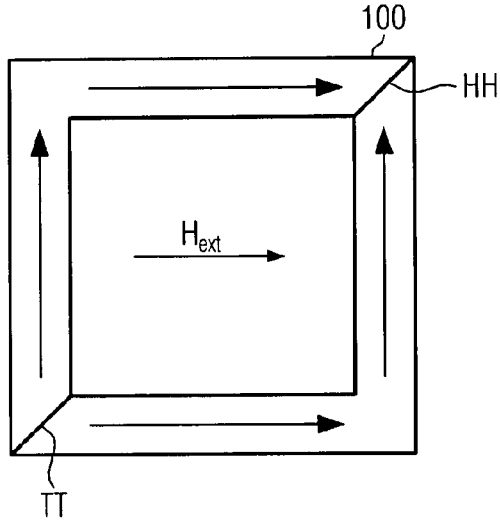
FIG. 1*c* schematically displays the principle at the basis of the movement of domain walls in a system similar to the one shown in FIG. 1*a*.

One of the interesting properties of domain walls in structures similar to the square ring shown in FIG. 1*a* is the possibility of moving said walls in a control way within the structure itself (see for example P. Vavassori, M. Grimsditch, V. Novosad, V. Metlushko, and B. Ilic, Phys. Rev. B 67, 134429 (2003)). In FIG. 1*c* the principles at the base of the movement of domain walls in a square ring structure 100 such as shown in FIG. 1*a* are shown. Once the domain walls HH and TT have been created in the upper left vertex and in the lower right vertex, respectively, of the ring as shown with respect to FIG. 1*b*, said domain walls are stable and remain unchanged even removing the field $H_0$ by means of which they have been created. Applying now an external field $H_{ext}$ directed along the x axis in the positive direction and sufficiently intense so as to invert the uniform magnetization of the horizontal sides of the square ring 100, the configuration shown in FIG. 1*c* is realized. The magnetization of the vertical sides of the ring remains unchanged, directed towards the positive direction of the y axis since the field $H_{ext}$ has zero component in this direction. On the contrary, further to the action of the field $H_{ext}$, the horizontal sides of the ring display a uniform magnetization directed along the positive direction of the x axis. Consequently, the domain wall HH is now placed at the upper right vertex of the ring 100, while the domain wall TT is placed in the lower left vertex. Basically, removing the field $H_0$ and applying the field $H_{ext}$, the movement of the domain walls inside the ring 100 is performed.

It is known from the literature (P. Vavassori, V. Metlushko, B. Ilic, M. Gobbi, M. Donolato, M. Cantoni, and R. Bertacco, Appl. Phys. Lett. 93, 203502, 2008) and from the Italian Patent Application TO2008A00314 that domain walls such as those shown in FIGS. 1*a*, 1*b* and 1*c* are characterized by the property of attracting magnetic particles. This is due to the fact that domain walls are geometrical structures confined in a narrow space (typically in the order of 10 nanometers to 100 nanometers) and produce intense magnetic fields (up to several kOe) which are in turn localized. Therefore, the high gradient of the field produced in proximity of a domain wall generates an attractive force capable of trapping magnetic particles.

From the energetic point of view, a domain wall creates a potential well capable of defining a stable binding configuration between the particle and the wall itself. This effect is observed both for ferromagnetic particles, i.e. particles with stable magnetic dipole moment at room temperature, and for superparamagnetic particles, i.e. particles with zero total magnetic dipole moment at room temperature but capable of assuming a high magnetic dipole moment (induced) in the presence of an external magnetic field. In the case of ferromagnetic particles, the elevated gradient of the magnetic field generated by a domain wall orientates and attracts the magnetic dipole of the particles. In the case of superparamagnetic particles, the elevated gradient of the magnetic field generated by a domain wall induces a magnetic dipole moment in the particles and, consequently, attracts them. In general, therefore, the presence of domain walls creates an effective trapping and focalization action on nano- or micro-particles. The attraction force created by a domain wall on a superparamagnetic particle is given by the expression:

$$F=\mu_0(\mu\cdot\nabla)H,$$

wherein $\mu=\mu(H)h$, where $\mu(H)$ is the magnetization curve of the particle as function of the intensity of the magnetic field H to which the particle is subject to, and h is a unity vector parallel to the magnetic field H.

Figure 2:
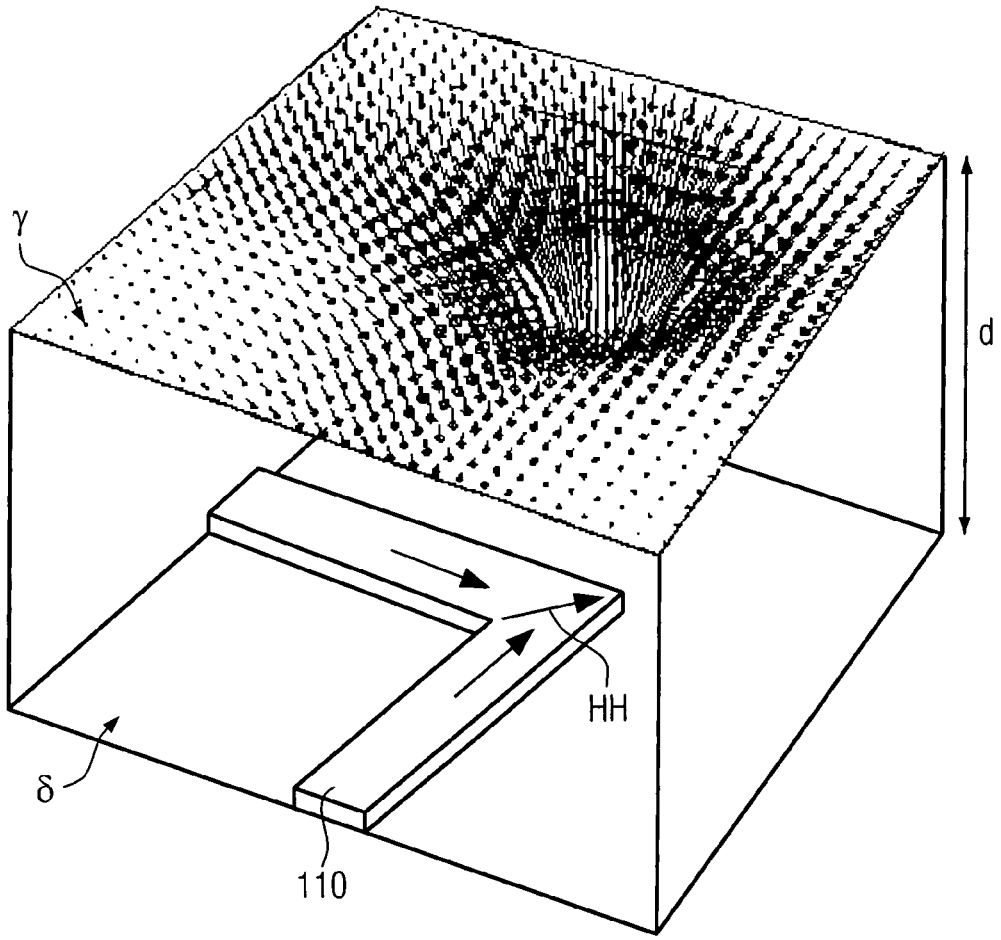
FIG. 2 displays a vector diagram of the force acting on a superparamagnetic nano-sphere placed on a plane above a domain wall.

FIG. 2 schematically shows a vector diagram of the force acting on a superparamagnetic nanosphere whose centre lies in a plane γ placed above a domain wall HH. The domain wall is placed on the plane δ parallel to the plane γ at a distance d from same. The vector diagram shown in FIG. 2 clearly shows that the nanoparticle is attracted toward the domain wall in proximity of which the attraction force is intense.

For a permalloy having a thickness of 30 nm and with the width of the segments defining the corner 110 corresponding to 200 nm, it is found that the force acting on a Nanomag®-D particle having a diameter of 130 nm placed at a distance d equal to 100 nm from the permalloy surface and centred on the domain wall has a value of about 10 pN.

Exploiting the property of moving in a controlled way domain walls by means of the application of external magnetic fields and the attraction property that the domain walls exert on magnetic particles, it is possible to manipulate said particles in suspension with precision.

Figure 3A:
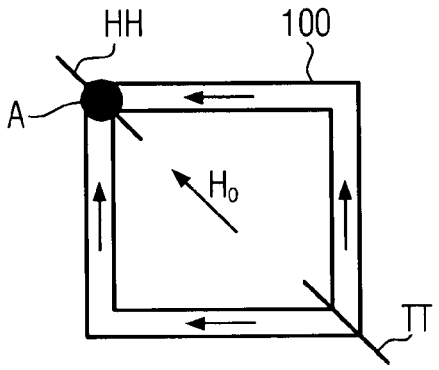
FIGS. 3*a* and 3*b* schematically display the principle at the base of the movement of superparamagnetic particles by means of the movement of magnetic walls in a system similar to the one shown in FIG. 1*a* according to a particular embodiment of the present invention.
Figure 3B:
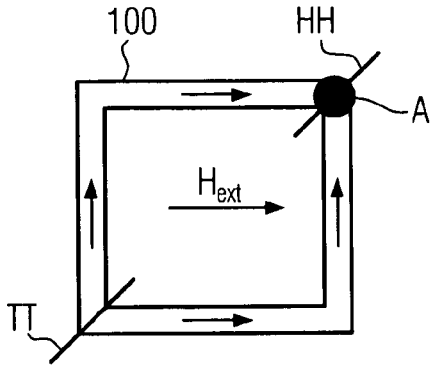

FIGS. 3*a* and 3*b* schematically show the principle at the base of the movement of the superparamagnetic particles by means of the movement of domain walls in a square ring 100 such as the one shown in FIG. 1*a*.

The square ring 100 is provided with two domain walls HH and TT at the upper left vertex and at the lower right vertex, respectively, by means of an external field $H_0$ in a similar way to what described with respect to FIG. 1*b*. Afterward, a solution comprising magnetic particles is dispersed in proximity of the ring 100. As a consequence of the attraction exerted by the domain walls HH and TT on the magnetic particles as described above, some of the particles are trapped in proximity to said domain walls. In particular, in FIG. 3*a*, the particle A is trapped in proximity of the domain wall HH in the upper left vertex of the ring 100. It is possible to proceed now in a similar way to what is described with respect to FIG. 1*c* so as to move the domain wall HH on the upper right vertex of the ring 100 and the domain wall TT on the lower left vertex of the ring 100. As shown in FIG. 3*b*, the particle A trapped in proximity to the domain wall HH follows the motion of said domain wall and is moved in a controlled way with respect to its starting position.

Figure 3C:
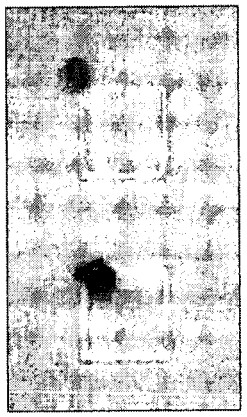
FIGS. 3*c* and 3*d* display two experimental images taken by means of an optical microscope showing the displacement of a superparamagnetic nanosphere by means of the movement of magnetic walls in a two real square shaped rings similar to the one shown in FIG. 1*a*.
Figure 3D:
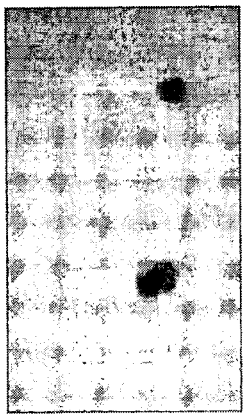

FIGS. 3*c* and 3*d* display the experimental results obtained by means of an optical microscope on a group of systems similar to the one schematically shown in FIG. 1*a*.

The square rings shown in FIGS. 3*c* and 3*d* are made of permalloy deposited by means of lithographic techniques on a substrate of $SiO_2$/Si. The thickness of the permalloy layer is 30 nanometers. The rings have dimensions of 6 μm×6 μm and the width of each segment of the square is equal to 200 nm. The rings are covered by a protective layer of $SiO_2$ having a thickness of 50 nanometers. Further to the application of an external field $H_0$ having intensity of 1000 Oe directed along the diagonal of the image connecting the lower right vertex with the upper left vertex, each of the rings assumes a configuration such as the one schematically shown in FIG. 1*b* with the domain walls HH and TT in the vertexes in the upper left vertex and the in the lower right vertex, respectively, of each ring. FIG. 3*c* has been acquired after having removed the external field $H_0$ and after deposition of a magnetic particle solution (Nanomag®-D, diameter 500 nm) with a concentration of $10^6$ particles/μl on the system so configured. As can be seen in FIG. 3*c*, in this particular experiment, some of the particles are trapped at the upper left vertexes of the two square rings where the domain wall HH is placed.

FIG. 3*d* displays an image acquired with the optical microscope after having applied an external field $H_{ext}$ horizontally directed toward the right. Consequently, the domain walls move as schematically shown in FIG. 1*c* and are placed in the upper right vertex and in the lower left vertex of each square ring. As can be seen in FIG. 3*d*, the magnetic particles follow the motion of the domain wall HH and are located in the upper right vertexes of the rings. In practice, the magnetic particles have been displaced by 6 μm in a completely controlled way simply acting on the external fields $H_0$ and $H_{ext}$.

In reality, it is known from the literature, (see for instance: D. A. Allwood, Gang Xiong, M. D. Cooke, C. C. Faulkner, D. Atkinson, N. Vernier, and R. P. Cowburn, Science 296, 2003 (2002)), that the movement of domain walls occurs in a very short time (a few nanoseconds for a distance of the order of 1 μm) after the application of $H_{ext}$. On the contrary, experimental data shown herewith, have displayed that the movement of the magnetic particles occurs in a delayed way with respect to the movement of the domain walls. In particular, it has been measured that the movement of the magnetic particles occurs in a timing of a few hundreds milliseconds after the application of $H_{ext}$ in case the solvent is an aqueous solution of $NH_4$—OH with pH 8. This is in particular due to the other forces playing a role in the system, such as, for example, the friction due to the viscosity of the solvent, the electrostatic interactions between the particles, substrate and solvent, the Brownian motion. Despite this temporary delay, however, the particles accurately follow the motion of the domain walls thanks to the elevated attraction exerted by the latter, at least for displacement spaces up to some micrometers. However, it has to be noted that the maximum length of the rectilinear spaces along which a domain wall is moved guaranteeing that the magnetic particles are not lost during the motion from one end to the other, strongly depends on the specific characteristics of the particles, of the solvent and of the substrate considered, and on the thickness of the permalloy nanostructures. In particular, an increase of the thickness implies an increase of the attraction force and this degree of freedom may be employed to increase the length of the displacement distance.

The controlled manipulation of magnetic particles shown in the previous Figures is implemented according to several aspects of the present invention as exemplified in the following.

Figures 4A, 4B, 4C, 4D:
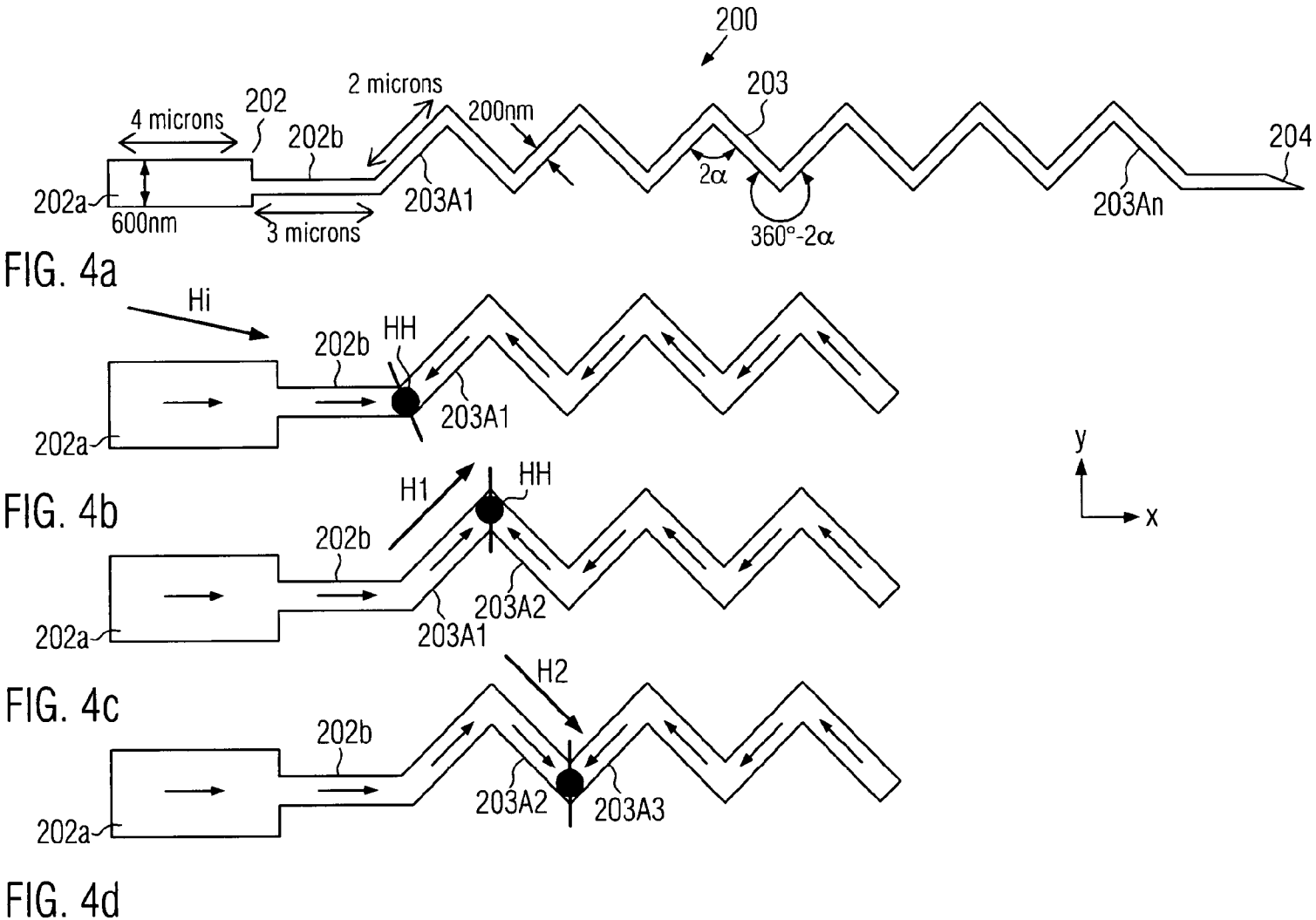
FIG. 4*a* displays a magnetic conduit having a zigzag structure according to a particular embodiment of the present invention.
FIG. 4*b* displays the creation of a domain wall in the conduit shown in FIG. 4*a* with a superparamagnetic nanosphere trapped by said domain wall.
FIGS. 4*c* and 4*d* display the propagation of a domain wall and of the trapped superparamagnetic nano-sphere in the conduit shown in FIG. 4*a*.

FIG. 4*a* displays a magnetic conduit 200 structured according to a particular embodiment of the present invention. The magnetic conduit 200 comprises an injector 202 employed for the creation of domain walls in the magnetic conduit 200 according to the procedure described in detail in the following. The injector shown in FIG. 4*a* comprises two rectangles 202*a* and 202*b*. The magnetic conduit 200 further comprises a zigzag structure 203 formed by a series of adjacent segments 203A1, 203An having the same length and placed in a zigzag way so that the angles formed between two adjacent segments have widths 2α or 360°-2α. In the particular embodiment of the present invention shown in FIG. 4*a*, 2α corresponds to 90°. The magnetic conduit 200 further comprises an ending 204 for the annihilation of domain walls. The ending 204 shown in FIG. 4*a* is pointed.

The zigzag structure formed by the adjacent segments 203A1, 203An forms a series of isosceles triangles, iso-oriented and placed so that two adjacent triangles share one of the base vertexes. The vertex angle of each isosceles triangle measures 2α, while, because of the geometry of the system, the two angles at the base measure 90°-α.

Moreover, for simplicity of the description of the Figure, a Cartesian frame of reference x-y is considered, wherein the x axis is parallel to the base of the isosceles triangles. In this way, the angle formed by one of the segments 203A1, 203An with the x axis is equal to 90°-α, while the angle formed with the y axis is equal to α.

Adjacent segments 203A1, 203An are initially magnetized in a uniform way applying an external magnetic field $H_0$ having a negative component along the y axis so that there are no domain walls in the system. In this way, the magnetization vector of each segment of the magnetic structure 200 has a component directed along the negative direction of the x axis.

After having removed the field $H_0$, a magnetic external field $H_i$ whose intensity is lower than the intensity of the field $H_0$ is applied. The field $H_i$ is mainly directed along the positive direction of the x axis, but with a small negative component along the y axis so as to allow the wall to stop in the corner between the segments 202*b* and 203A1. Preferably, the component along the y axis is so that the field forms an angle not wider than 20° with the x axis. In this way, a magnetic domain is created in the injector 202 whose magnetization vector is directed along the positive direction of the x axis. On the contrary, the magnetization vectors of the adjacent segments 203A1, 203An maintain a component along the negative direction of the x axis. This is possible because of the geometry of the injector 202. In particular, the first rectangle 202*a* of the injector is wider than the adjacent segments 203A1, 203An of the zigzag structure and accordingly it is characterized by a lower shape anisotropy. For this reason, the magnetic field necessary to invert the magnetization of the injector is lower than the magnetic field necessary for obtaining the same inversion in the adjacent segments 203A1, 203An.

The presence of the field $H_i$ allows therefore, the creation of a domain wall HH between the injector 202 and the first segment 203A1 of the series of adjacent segments 203A1, 203An as shown in FIG. 4*b*.

As shown in FIG. 4*c*, a field $H_1$ parallel to the first segment 203A1 of the series of adjacent segments 203A1, 203An is applied afterwards. The intensity of the field $H_1$ is higher than the intensity of the critical field necessary to move the domain wall by means of the inversion of the magnetization of the segment 203A1 but it is lower than the field $H_n$ necessary for simultaneously inverting the magnetization of all the segments 203An (with n odd), and that would imply the creation of a micro-magnetic configuration with a domain wall at each corner of the conduit. In this way, the domain wall HH is moved and is placed between the first segment 203A1 and the second segment 203A2 of the series of adjacent segments 203A1, 203An.

As shown in FIG. 4*d*, a field $H_2$ parallel to the second segment 203A2 of the series of adjacent segments 203A1, 203An is subsequently applied. For the symmetry of the system, the intensity of the field $H_2$ is equal to the intensity of $H_2$. In this way, the domain wall HH is moved and it is placed between the second segment 203A2 and the third segment 203A3 of the series of adjacent segments 203A1, 203An.

Accordingly, applying a sequence of fields $H_1$ and $H_2$ as described above, the controlled movement of the domain wall HH along the magnetic structure 200 towards the n-th segment 203An, is realised.

In order to invert the direction of the motion of the domain wall HH, it is necessary to invert the direction of the fields $H_1$ and $H_2$ so as to move the domain wall HH along the magnetic structure 200 toward the first segment.

The intensities of the fields $H_0$, $H_i$, $H_1$, $H_2$, $H_n$ depend both on the magnetic properties of the magnetic structure 200 and on the geometric properties of said structure. In particular, the width and the thickness of the injector 202 and of the series of adjacent segments 203A1, 203An and the angle $2\alpha$ between adjacent segments, determine the values of the intensity of the fields $H_0$, $H_i$, $H_1$, $H_2$ and $H_n$.

In general, said magnetic fields increase decreasing the length and the width of the conduit.

Considering the geometry of the structure 200 shown in FIG. 4, it is possible to uncouple the two processes of creation and movement of the domain wall if the projection of $H_i$ onto the direction of the slanting sides of the zigzag structure is lower than the intensities of $H_1$ and $H_2$, so that the injection does not cause the propagation of the domain wall.

The vertexes of the triangles defined by the zigzag structure formed by the adjacent segments 203A1, 203An are stable positions for the domain walls. Consequently, a magnetic particle attracted by a domain wall placed in one of these vertexes may be kept in this position for an indefinite time in the absence of external magnetic fields. Moreover, moving a domain wall along the magnetic structure 200 as described above, the magnetic particle is moved in a controlled way as well.

In a particular embodiment of the present invention, the magnetic structure 200 is characterized by an injection structure 202 composed by two rectangles 202*a* and 202*b* having dimensions of 4 μm×0.6 μm and 3 μm×0.2 μm, respectively; and by adjacent segments 203A1, 203An 2 μm long and 0.2 μm wide. The thickness of the structure is 0.03 μm. The intensities of the fields preferably employed for this structure are: $H_0$=1000 Oe, $H_i$=140 Oe, $H_1$=$H_2$=150 Oe. The angle formed by $H_i$ with the horizontal direction is preferably 50°. For the sake of completeness, the value of the field $H_n$=300 Oe is also quoted. In a structure of this kind, it has been observed that the transfer speed of the magnetic particles bound to the domain wall is in the order of 0.5 mm/s.

A further application of the magnetic structure 200 is shown in FIG. 5.

Figure 5A:
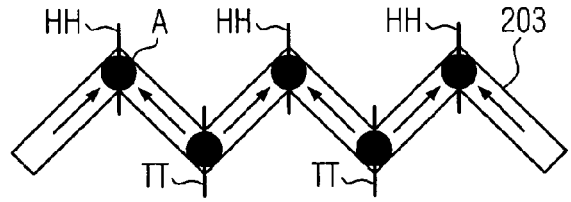
FIG. 5 displays the principle at the base of the trapping a and release b of superparamagnetic particles by means of a conduit having a zigzag structure similar to the one shown in FIG. 4.
Figure 5B:
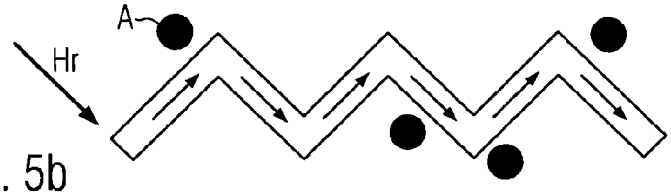

After the realization of an initial magnetic configuration wherein adjacent segments are uniformly magnetized so that there are no domain walls, a magnetic field $H_t$ along the positive direction of the y axis (i.e. having 0 component along the x axis) is applied. In this way, a configuration is realised wherein a domain wall is present at each vertex of the zigzag structure as shown in FIG. 5*a*. The domain walls HH and TT alternate. Each vertex is accordingly able to attract and trap magnetic particles independently from the kind of domain wall present. Subsequently, the release of the magnetic particles as shown in FIG. 5*b* is obtained by applying a magnetic field $H_r$ able to annihilate the domain walls. According to a particular embodiment of the present invention, with the dimensions and material specified above, the values of the intensities of the fields preferably employed are: $H_t$=400 Oe, $H_r$=150 Oe.

The magnetic structure 200 shown in FIG. 4 is not adapted for the injection and propagation of several domain walls because the walls TT and the walls HH would propagate in opposite directions under the action of the same field. This would be disadvantageous in the event that any number of magnetic particles is to be transported along the same conduit. The propagation of the walls TT and HH in opposite directions would in fact prevent an effective progressive motion of the particles. In order to remedy this problem, it is necessary to build a magnetic conduit wherein stable positions for the domain walls HH are created with respect to the fields necessary to move the domain walls TT and vice versa.

Figure 6:
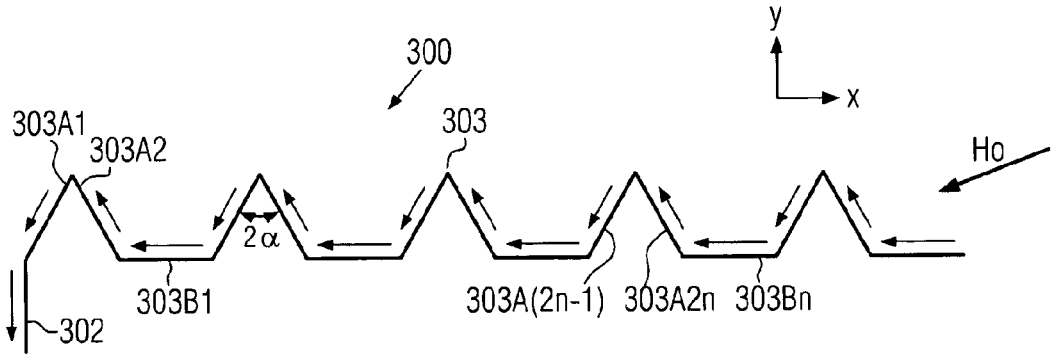
FIG. 6 schematically displays a conduit having a modified zigzag structure according to a particular embodiment of the present invention.

An example of this kind of magnetic conduit according to a particular embodiment of the present invention is schematically shown in FIG. 6. FIG. 6 displays a magnetic conduit 300 with a modified zigzag structure 303. In particular, the magnetic conduit 300 comprises adjacent segments 303A1, 303A2, 303B1, . . . , 303A2*n*-1, 303A2*n*, 303BN placed so as to form triangles without base alternated to horizontal segments. In the example shown in FIG. 6, the triangles are equilateral and the horizontal segments have the same length as the sides of the triangles. In practice, the zigzag structure shown in FIG. 6 can be described as a series of adjacent half-hexagons wherein adjacent half-hexagons have a vertex in common. The magnetic conduit 300 further comprises an injection structure 302.

Applying an appropriate external magnetic field $H_0$ oriented along the negative direction of the x axis and with a small negative component along the y axis so that the field preferably forms an angle of about 10° with the direction of the horizontal segments (in order to saturate the magnetization of the whole structure, segments 302 included), the initial magnetization state is realised as shown in FIG. 6 and in FIG. 7*a*. Said negative component along the y axis has the function to facilitate the creation of a single domain in the entire structure comprising the segment 302 oriented according to the y axis.

Figure 7:
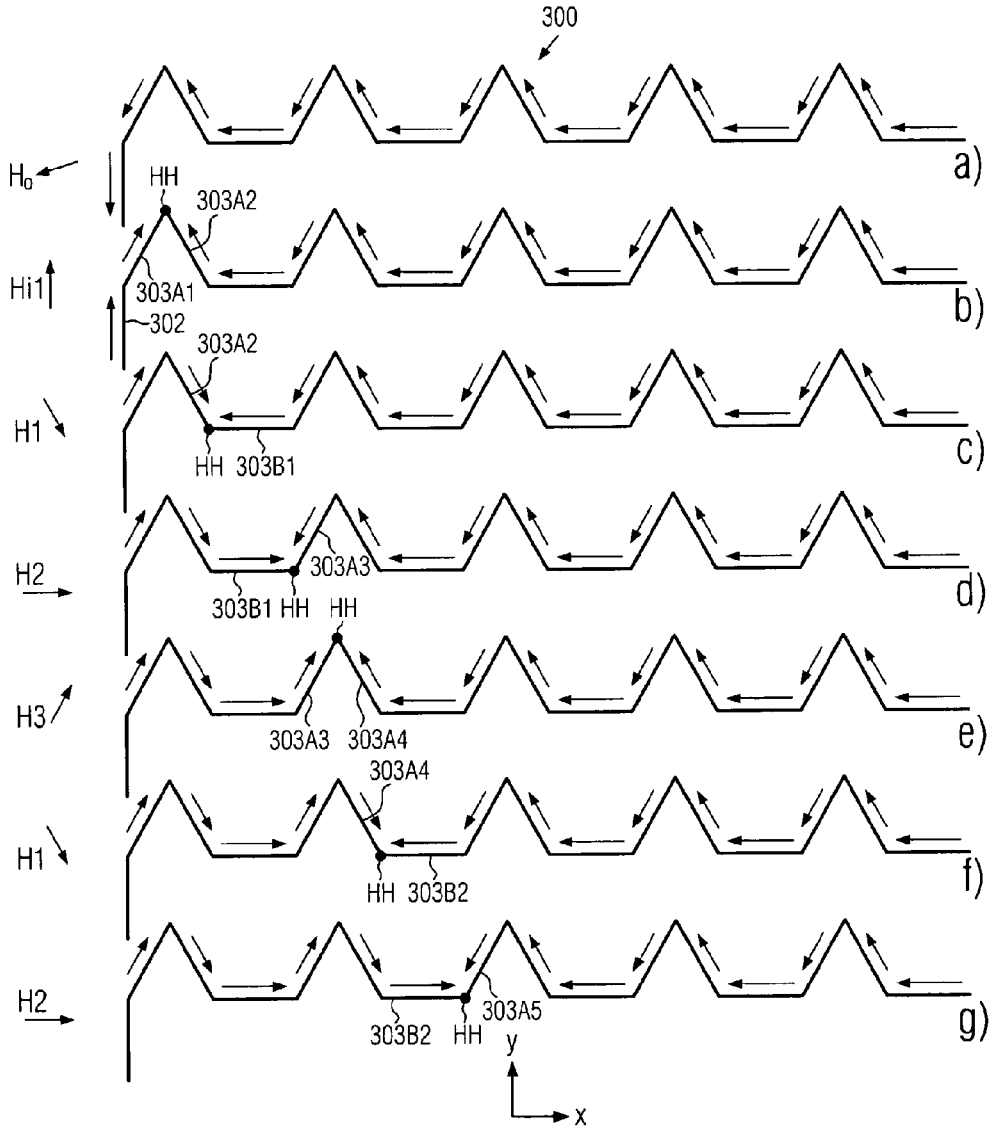
FIG. 7 schematically displays the creation and the propagation of a first domain wall (domain wall HH) in a conduit similar to the one shown in FIG. 6.

FIG. 7 displays the creation and the propagation of a first domain wall HH in the magnetic conduit 300. After the removal of the field $H_i$, a magnetic field $H_{i1}$ with a positive component along the y axis, is applied (FIG. 7*b*). In this way, the injection structure 302 and the first segment 303A1 assume a new magnetization with respect to the initial state. In particular, the magnetization of the segment 303A1 is inverted with respect to the initial state and a domain wall HH is created between the first segment 303A1 and the second segment 303A2 of the modified zigzag structure. Applying an external magnetic field $H_1$ parallel to the segment 303A2, the magnetization of said segment is inverted and a domain wall HH is moved so as to place it between the second segment 303A2 and the first horizontal segment 303B1 (FIG. 7*c*). Applying an external magnetic field $H_2$ parallel to the first horizontal segment 303B1, the magnetization of said segment is inverted and the domain wall HH is moved so as to place it between the first horizontal segment 303B1 and the segment 303A3 (FIG. 7*d*). Applying an external magnetic field $H_3$ parallel to the segment 303A3, the magnetization of said segment is inverted and a domain wall HH is moved so as to place it between the segment 303A3 and the segment 303A4 (FIG. 7*e*).

Proceeding in a similarly to what is shown in FIG. 7*c*, an external field $H_1$ parallel to the segment 303A4 is applied so as to move the domain wall HH and to place it between the segment 303A4 and the second horizontal segment 303B2 (FIG. 7*f*).

Proceeding similarly to what is shown in FIG. 7*d*, an external field $H_2$ parallel to the second horizontal segment 303B2 is applied so as to move the domain wall HH and to place it between the second horizontal segment 30362 and the segment 303A5 (FIG. 7*g*).

The intensities of the magnetic fields applied have to satisfy appropriate conditions. For example, the field $H_1$ has to be so as to avoid that the propagation of the domain wall along the segments 303A2*n* causes the undesired injection of further domain walls. Moreover, the intensity of the field $H_{i1}$ has to be lower than the intensity of the field $H_n$ necessary to invert the magnetization of all the segments 303A2*n*-1, creating two walls at the endings of each segment 303A2*n*-1. More in general, it is necessary that the fields $H_1$, $H_2$, $H_3$ employed for the motion of the wall HH respectively along the segments 303A2*n*, 303Bn, 303A2*n*-1 determine only the inversion of the magnetization of the segments to which they are associated and at the extremities of which there is already a domain wall, without any further perturbation of the magnetization of the other segments.

The conditions that have to be satisfied by the intensities of the magnetic fields may be realized in several ways, such as for instance by varying the width of the segment defining the injection structure 302.

According to particular embodiments of the present invention, the magnetic fields employed have intensity in the order of some hundreds of Oe.

Figure 8:
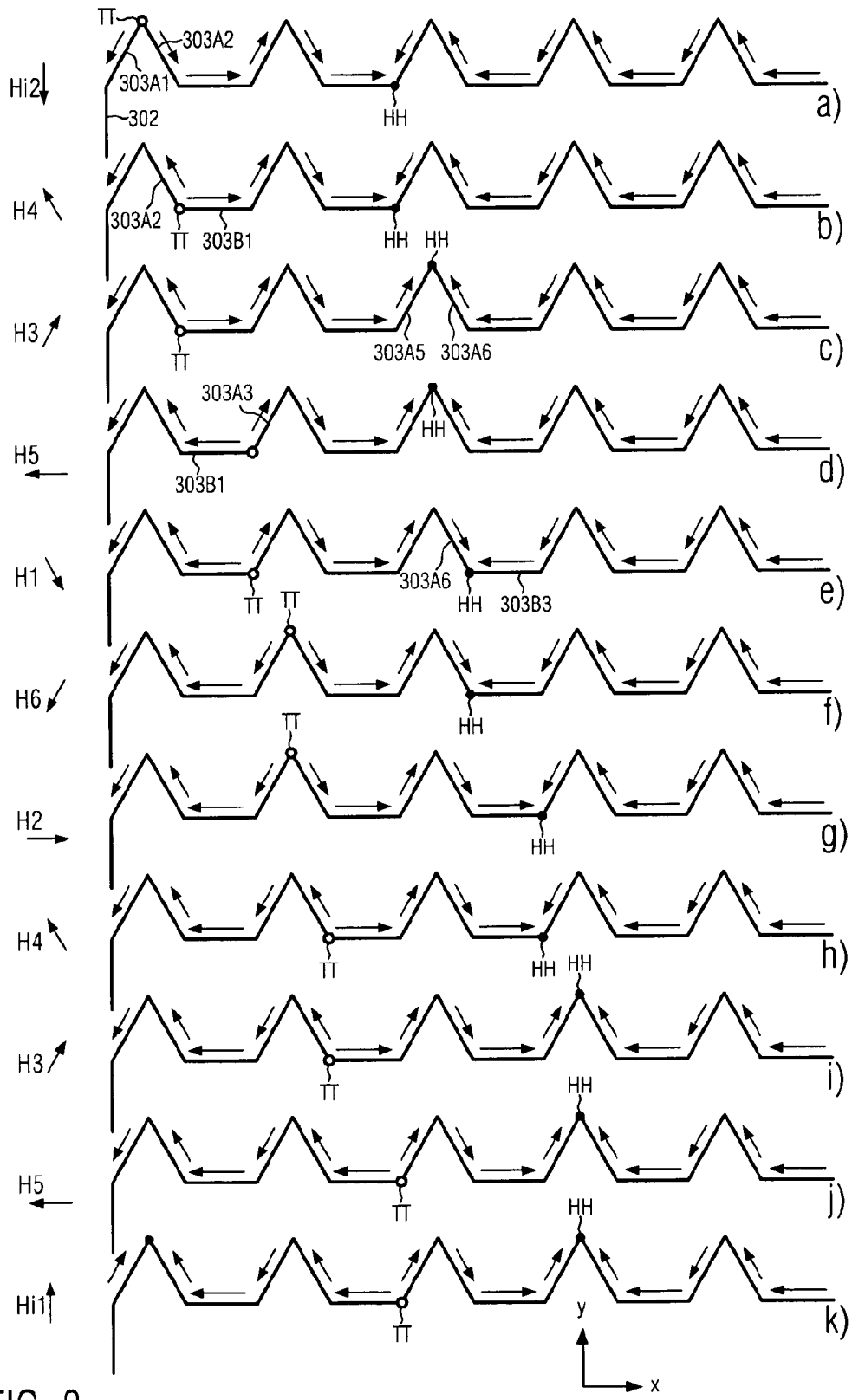
FIG. 8 schematically displays the creation and the propagation of a second domain wall (domain wall TT) domain in the system shown in FIG. 7.

The state shown in FIG. 7*g* is a stable state with respect to the external magnetic field necessary for injecting a second wall TT in the magnetic conduit 300. The injection and the movement of the wall TT are schematically shown in FIG. 8.

Applying an external magnetic field $H_{i2}$ oriented along the negative direction of the x axis, the magnetization of the first segment 303A1 of the magnetic conduit 300 is inverted and a TT wall between the first segment 303A1 and the second segment 303A2 is created (FIG. 8*a*). The magnetic field $H_{i2}$ does not have effective components for the inversion of the magnetization of the segments 303B2 and 303A5 between which the wall HH is placed. For this reason the wall HH is not moved when the wall TT is injected.

The movement of the wall TT is performed in a similar way to what described above with respect to the movement of the wall HH. In particular, external magnetic fields able to invert the magnetization of one of the segments between which the domain wall is placed are applied.

Applying an external magnetic field $H_4$ parallel to the segment 303A2 the magnetization of said segment is inverted and the wall TT is moved so as to place it between the segment 303A2 and the first horizontal segment 303B1 (FIG. 8*b*). The field $H_4$ has to be so as to only produce the inversion of the magnetization of the segment 303A1 without influencing the position of the wall TT.

Applying an external magnetic field $H_3$ parallel to the segment 303A5 the magnetization of said segment is inverted and the wall HH is moved (FIG. 8*c*). The field $H_3$ does not provoke variations of the magnetizations of the segments between which the domain wall TT is placed and accordingly this wall is not moved.

Applying an external magnetic field $H_5$ parallel to the segment 303B1 the magnetization of said segment is inverted and the wall TT is moved so as to place it between the segments 303B1 and the segment 303A3 (FIG. 8*d*). In this case, however, in order to prevent the wall HH from moving, $H_5$ has to be appropriately chosen.

Applying an external magnetic field $H_1$ parallel to the segment 303A6 the domain wall HH is moved (FIG. 8*e*).

Proceeding in a similar way applying appropriate external magnetic fields, the configuration shown in FIG. 8*j* is obtained. This configuration is stable with respect to the injection of a new domain wall HH as shown in FIG. 8*k*.

As remarked in the description of the movement of the walls, there are some critical points in the choice of the fields to apply, said critical points imply the following conditions:

a) the fields $H_1$, $H_2$, $H_3$ employed for the movement of the wall HH along the segments 303A2*n*, 303Bn, 303A2*n*-1, respectively have to determine only the inversion of the magnetization of the segments to which they are associated and at the endings of which a domain wall is already present without any further perturbation of the magnetization of the other segments. In particular they do not have to determine the injection of further walls;

b) the fields $H_4$, $H_5$, $H_6$ employed for the movement of the wall TT along the segment 303A2*n*, 303Bn, 303A2*n*-1, respectively, have to determine only the inversion of the magnetization of the segments to which they are associated and at the endings of which a domain wall is already present without any further perturbation of the magnetization of the other segments. In particular, they do not have to cause the injection of further walls;

c) the injection fields do not have to alter the magnetization states of parts of the structure other than the injector in the micro-magnetic configuration characteristic of the moment in which they are applied.

The way according to which these conditions are realized for instance in terms of directions and intensities of the fields to apply strongly depend on the geometry and the material employed, so that the scheme shown in FIG. 8 has to be understood as representative of the principle that can be exploited according to several practical realizations. In particular, it is not necessary that the fields be parallel to the segments of the structure.

Figure 9:
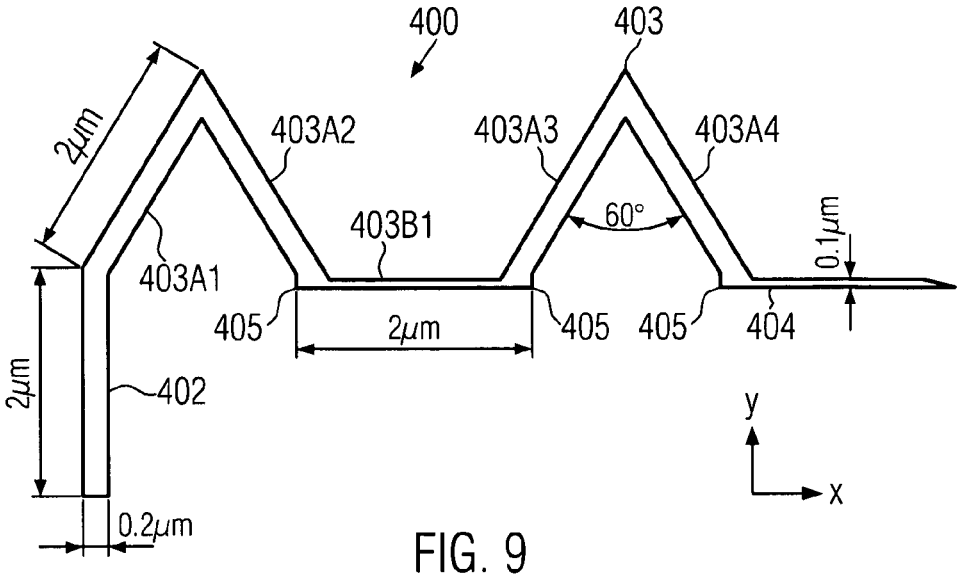
FIG. 9 schematically shows the structure of a magnetic conduit according to a particular embodiment of the present invention.

FIG. 9 schematically shows a magnetic conduit 400 according to a particular embodiment of the present invention, and in particular according to the scheme shown in FIG. 8, employed for the simulation of the creation and of the propagation of domain walls HH and TT. The magnetic conduit 400 is provided with an injection structure 402 0.2 μm wide and 2 μm long. The segments 303A1, 303A2, 303A3 and 303A4 are 2 μm long and 0.2 μm wide. The angle 2α between adjacent segments is equal to 60° so that the triangles formed are equilateral triangles. The horizontal segment 303B1 is 2 μm long and 0.1 μwide. A corner 405 with an angle of 90° is present in correspondence with the endings of the slanting segments in order to stabilize the walls in said positions. The ending 404 for the annihilation of the domain walls is pointed and has a maximum width of 0.1 μm. The magnetic conduit 400 may be formed by permalloy with a thickness of 30 nm deposited on a $SiO_2$/Si substrate.

Figure 10A:
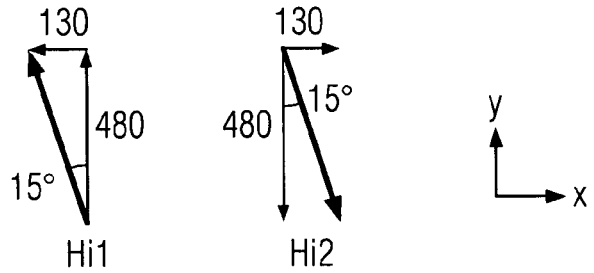
FIG. 10 schematically shows the component along the x and y directions of the magnetic fields employed for the creation and the propagation of the domain walls HH and TT in a magnetic conduit such as shown in FIG. 9. The magnetic field intensities are expressed in Oe units.
Figure 10B:
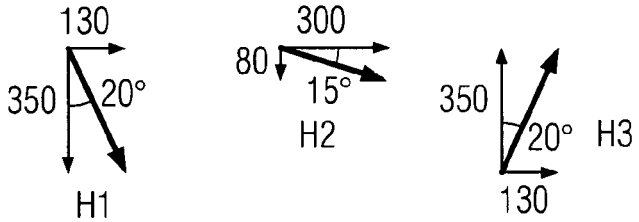
Figure 10C:
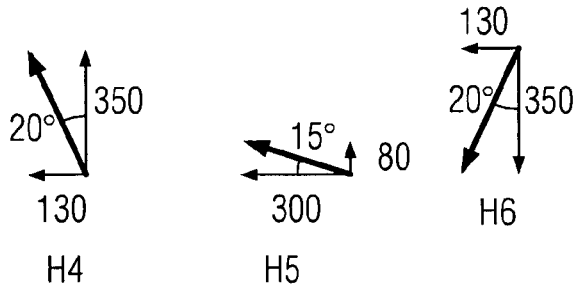

The necessary fields for the creation and the movement of magnetic particles in a structure such as the one shown in FIG. 9 and obtained by means of appropriate micro-magnetic simulations are shown in FIG. 10. The magnitudes of the vectors shown (intensities of the fields) are expressed in Oe. The nomenclature of the fields is the same as the one employed for FIGS. 7 and 8 for which these processes have been described in detail. In particular, however, different from what shown in FIGS. 7 and 8, the fields employed according to the embodiment of the present invention described in FIGS. 9 and 10 are not parallel to the segments of the magnetic conduit 400. This is due to the fact that it has been observed that magnetic fields slanted with respect to the segments of the conduit facilitate the arrest of the domain walls at the endings of the segments and reduce the injection fields. In particular, it is possible to observe in FIG. 10*a* that the injection magnetic fields $H_{i1}$ and $H_{i2}$ are tilted by 15° with respect to the injection structure 402. The magnetic fields for the movement of the walls HH are tilted by 10° with respect to the segments 403A2 and 403A1 and by 15° with respect to the horizontal segment 403B1 (FIG. 10*b*). In a similar way, the magnetic fields for the movement of the walls TT are tilted by 10° with respect to the segments 403A2 and 403A1 and by 15° with respect to the horizontal segment 403B1 (FIG. 10*c*).

Choice of the angles at which the fields are applied as well as the magnitudes of said fields allow the fulfillment of the conditions a, b, and c described above guaranteeing the decoupling of the injection of walls HH and TT from the propagation of said walls.

The employment of magnetic conduits comprising segments and corners, such as the magnetic conduits shown in FIGS. 1, 4, 6, and 9 allow the precise control of the creation and the movement of domain walls. In particular, thanks to the presence of corners wherein the domain walls are extremely stable, it is possible to precisely know the location of said domain walls. In a similar way in case the magnetic particles are bound to said domain walls, it is possible to precisely know the location of said particles. In general the maximum theoretical precision with which the localization of magnetic particles is known corresponds to the extension of the domain walls. Accordingly, the maximum precision with which the localization of the magnetic particles is known in conduits properly structured according to the present invention is in the order of 10 nanometers. This precision may be significantly reduced up to some few hundreds of nanometers because of external perturbative reasons such as the Brownian motion of the particles in solution and the presence of irregularities in the magnetic structures.

The motion of the domain walls based on segments and corners is a digital motion. In particular, while the starting and ending points of the movements of the domain walls are precisely known and correspond to the endings of the segments along which the domain walls are moved, it is not easy to control the nature and the motion of said walls during the movement between an ending and the next ending. On rectilinear segments it is difficult to reduce the speed of the walls in such a way that the particles can be moved with continuity following the walls themselves. Moreover, if during the motion the domain wall assumes a vortex structure instead of the typical transversal structure, it is possible that the magnetic particles are released. For avoiding this inconvenience, according to a particular advantageous embodiment of the present invention, magnetic conduits formed by curved segments are employed. The motion of domain walls along curved segments is a continuous motion with a speed equal to the rotation speed of an external magnetic field and accordingly controllable.

FIG. 11 displays a particular embodiment of the present invention based on a magnetic conduit 500 having the shape of a circular ring. The circular structure of the magnetic conduit 500 allows the precise control of the nature of the domain walls and of their movement at each instant of the processes.

Figure 11A:
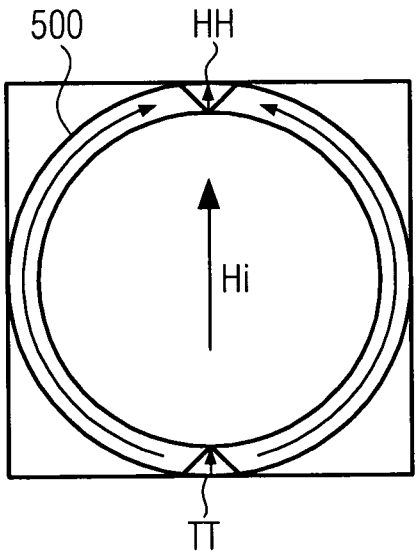
FIG. 11 schematically displays the creation and propagation of domain walls HH and TT in a conduit having a circular ring shape according to a particular embodiment of the present invention.
Figure 11B:
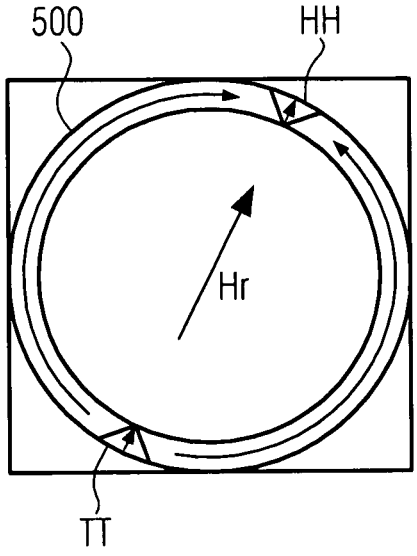

Applying an external saturation magnetic field $H_i$ a domain wall HH and a domain wall TT are created as shown in FIG. 11*a*. Applying a rotating radial magnetic field $H_r$ it is possible to move with extreme precision the domain walls along the circumference of the ring 500 (FIG. 11*b*). Controlling the rotation speed of the magnetic field $H_r$ it is possible to control the movement of the domain walls. In particular, the speed of rotation of the domain walls coincides with the speed of rotation of the magnetic field $H_r$. The intensity of the field $H_r$ is determined by the structure of the ring 500, in particular by the presence of possible irregularities in the circular structure and inhomogeneities in the material of the ring itself. Since the magnetic field $H_r$ is radial, the domain walls maintain their transversal structure during the entire movement.

As example, some experimental data on the efficiency of the movement of particles on permalloy rings having a ray equal to 5 μm and a conduit width of 0.2 μm is reported. In particular, in table 1 the maximum frequencies of rotation of magnetic particles are reported as function of the intensity of the rotating field $H_r$ applied. Higher frequency would cause the particles to decouple from the walls.

TABLE 1

| $H_r$ (Oe) | f (Hz) |
|---|---|
| 135 | 0.1 |
| 235 | 0.8 |
| 300 | 1 |

This data relate to the motion of Nanomag®-D particles with a diameter of 500 nm in an aqueous solution of $NH_4$—OH with pH 8 and to permalloy structures with a covering of $SiO_2$ 50 nm thick.

On a similar structure having radius of 10 μm, with a field $H_r$=300 Oe the maximum frequency of rotation is reduced to 0.5 Hz and the loss of the magnetic particles is often observed. This shows how the field necessary for the rotation of the particle and of the wall increases with the curvature radius.

At low rotations speeds of the field $H_r$ the controlled movement of magnetic particles allow a very precise positioning of same with an observed resolution of the order of 100 nanometers.

FIG. 12 displays a particular embodiment of the present invention with a magnetic conduit 600 having a curved shape. The magnetic conduit 600 comprises an injection structure 602 for the injection of domain walls, a curved portion 603 and an ending 604 for the annihilation of domain walls. The curved portion 603 corresponds to the portion of an ellipse. According to alternative embodiments of the present invention, the curved portion 603 may correspond to the portion of a parabola, a hyperbole or a circumference. The ending 604 is pointed. The magnetic conduit 600 is initially uniformly magnetized as is shown in FIG. 12*a* by means of an external magnetic field $H_0$ as in the Figure. Subsequently, the magnetic field $H_0$ is removed and an external magnetic field $H_i$ is applied essentially directed along the positive direction of the y axis but with a little negative component along the x axis so that $H_i$ is tilted with respect to the vertical direction. The field $H_i$ allows the injection of a domain wall HH in the curved portion 603 of the magnetic conduit 600 (FIG. 12*b*). Applying a rotating radial magnetic field H it is possible to move with high accuracy the domain wall HH along the entire curved portion 603 (FIGS. 12*c, d, e*). The micro-magnetic configurations shown in FIG. 12 synthetically summarize the results for appropriate simulations on a permalloy structure with a width of the conduit equal to 200 nm and a thickness of 30 nm. A 1000 Oe field $H_0$ has been applied tilted by 10° with respect to the horizontal direction for the initialization, while the fields $H_i$ and H correspond respectively to 200 Oe and 300 Oe, with $H_i$ tilted by 10° with respect to the vertical direction. The angular velocity of the rotation of the domain wall HH is equal to the angular rotation speed of the magnetic field H. The intensity of the field H necessary for a continuous and controlled movement is determined by the curvature radius (it increases with it) and by the structure of the curved portion 603, in particular by the presence of possible irregularities in the curved portion 603 and by inhomogeneities in the material of the curved portion itself. When the domain wall HH reaches the ending 604 it is annihilated (FIG. 12*f*). With the magnetic conduit 600 it is possible to move a magnetic particle along a distance equal to the diameter of the curved portion 603. In general said distance can be of the order of some tens of micrometers.

Considering a magnetic conduit 600 made of permalloy and 30 nm thick with a curved portion 603 0.2 μm wide and having a diameter of 10 μm, it has been calculated that the domain wall HH produces a magnetic field higher than 100 Oe at a distance of 200 nm from the permalloy structure. The high gradient of the field generated implies an attraction force equal to 10 pN on a superparamangetic particle Nonomag®-D having a diameter of 130 nm and with the center at 200 nm from the surface of the curved portion 603. This value is comparable with the value obtained in the case of a corner in a square ring. The forces calculated for the magnetic conduit 600 are accordingly sufficient to realize a stable coupling between the magnetic particles and the domain walls. Clearly, it is preferable that the $SiO_2$ protective layer deposited above the magnetic conduit 600 has the lowest possible thickness (50 nm for the experimental data shown herewith) in order to maximize the interaction force during the movement of the particles.

According to particular advantageous embodiments of the present invention magnetic conduits comprising sequences of connected curved portions having different magnetic properties, such as different curvature radiuses, different thicknesses and different widths, are realized.

It has been shown that by means of magnetic conduits properly structured according to the present invention it is possible to control in a very precise way the position and the movement of magnetic particles with nanometric resolution.

Figure 13:
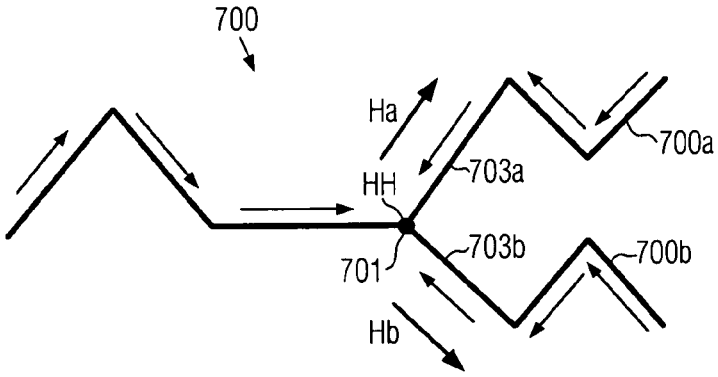
FIG. 13 displays a magnetic conduit with a bifurcation according to a particular embodiment of the present invention.

According to particular embodiments of the present invention, it is possible to realize magnetic conduits comprising bifurcations. The magnetic conduit 700 shown in FIG. 13 comprises the bifurcation 701 by means of which the magnetic conduit 700 is divided into the branches 700*a* and 700*b*. In FIG. 13, a domain wall HH placed at the bifurcation 701 is shown. If an external magnetic field $H_a$ able to invert the magnetization of the first segment 703*a* of the branch 700*a* is applied, the wall HH enters the branch 700A and can be propagated along this branch. On the contrary, if an external magnetic field $H_b$ is applied, able to invert the magnetization of the first segment 703*b* of the branch 700*b*, the wall HH enters the branch 700*b* and can be propagated along this branch.

The devices shown in FIGS. 1 to 13 display particular embodiments of the present invention comprising magnetic conduits properly structured. In particular, the magnetic conduits shown in FIGS. 1 to 13 are bi-dimensional systems of ferromagnetic material at room temperature (for instance, permalloy) deposited on a non-magnetic substrate (for instance, $SiO_2$, Si). The magnetic conduits shown may be further covered by a protective layer of non-magnetic material (such as $SiO_2$). Nevertheless, according to further embodiments of the present invention, three-dimensional magnetic conduits are provided. In this way, 3D networks are created along which it is possible to move several magnetic particles with extremely high precision and complete control. Accordingly, it is possible to realise the stratification of several environments wherein the magnetic particles can be selectively moved by means of the movement of domain walls. This allows the realization of ideal lab on a chip conditions wherein the stratification of environments in which different chemical reactions can occur is realized.

A further embodiment of the present invention consists in providing the magnetic conduit of the present invention with magnetic sensors able to detect the presence of domain walls and of magnetic particles bound to the magnetic walls. An example of said sensors can be found in the Italian patent application TO2008A00314 the teaching of which is incorporated herewith by reference in its entirety. The sensors described in TO2008A00314 are based on the detection of the presence of a domain wall in a magnetic conduit on the basis of the phenomena of anisotropic magnetoresistance. Basically, the electrical resistance of a magnetic conduit changes according to the presence or the absence of a domain wall in the conduit. By means of ohmic measurements, it is accordingly possible to determine the presence of domain walls in magnetic conduits. Moreover, the detection of the presence of a magnetic particle in proximity of a magnetic domain is based on the fact that the magnetic field necessary to move a domain wall along a magnetic conduit varies according to the fact that the domain wall is bound or not, to the magnetic particle. Accordingly, the sensors described in TO2008A00314 allow for the detection of domain walls in a magnetic conduit and the determination of whether said domain walls are bound or not to magnetic particles. These kinds of sensors are accordingly perfectly integrable in the structures described herewith. In order to perform ohmic measurements as described in TO2008A00314, it is possible to provide said magnetic conduits with electric contacts, for example, with gold electric contacts. Similar to the magnetic conduits, also the electric contacts may be realized by means of lithographic techniques. The presence of sensors in the magnetic conduits of the present invention allows the realisation of counters able to control with high precision the number of magnetic particles passing through a magnetic conduit.

The creation, movement and annihilation of domain walls in magnetic conduits according to embodiments of the present invention have been described in relation to the application of external magnetic fields. The external magnetic fields may be either continuous or alternate. According to alternative embodiments of the present invention, it is possible to perform the creation, movement and annihilation of the domain walls in the magnetic conduits by means of the application of electromagnetic external fields. According to further embodiments of the present invention, the creation, movement and annihilation of domain walls is performed by means of electric currents which are allowed to pass through magnetic conduits. This can be especially realized in the case in which the magnetic conduits are realized with magnetic materials characterized by a high spin polarization at the Fermi level such as, for example, manganites, Heussler alloys and magnetite. In order to let electrical current pass through magnetic conduits, it is possible to provide said magnetic conduits with electric contacts, for example, with gold electric contacts. Similar to the magnetic conduits, also the electric contacts may be realized by means of lithographic techniques.

It has been shown that it is possible to control with extreme precision and accuracy the movement of single magnetic particles by means of the creation, movement and annihilation of domain walls in magnetic conduits properly structured and placed in the presence of a solution of magnetic particles. By means of the accurate design of the structure (shape and dimensions) of said magnetic conduits, it is possible to trap single magnetic particles in predetermined positions by means of the creation of domain walls. It is furthermore possible to release single magnetic particles in determined positions by means of the annihilation of domain walls. It is also possible to move single magnetic particles in a controlled and precise way along magnetic conduits along which domain walls can be precisely moved.

This allows the employment of the method and system of the present invention in several fields wherein the controlled and precise manipulation of particles is required. In particular, the present invention may be employed in each field wherein the trapping, the movement, the accumulation and the transfer of magnetic particles is required. Examples of fields wherein the controlled manipulation of particles plays an important role concern, for example, biomedical applications wherein superparamagnetic particles are employed as markers or as support for the transfer of biological molecules. Some examples of application in these fields concern, for example, the case of bio-molecular identification by means of biosensors or the extraction and purification of DNA. By means of the present invention, the "lab on a chip" approach is improved in several application fields. The realisation of compact arrays of devices according to the present invention allow the trapping, transport and release of high quantities of magnetic particles as required, for example, in the event in which biological samples are to be prepared. Moreover, the present invention allows the realization of sorts of "magnetic tweezers" very accurate and precise employing curved conduits (it is possible to obtain a nanometric resolution) which could be employed, for example, in the fields of high controlled chemical or biological synthesis.

By means of several aspects of the present invention, it has been shown that it is possible to perform both extremely precise and controlled digital motion of magnetic particles and extremely precise and controlled continuous motion of magnetic particles according to the kind of application required.

The present invention is particularly advantageous in case of employment of magnetic particles functionalized, for example, by means of adhesive substances or of surface reactive groups in order to bind them to any kind of molecules, either biological or non-biological, independently from the fact that said molecules are magnetic or not. By means of the controlled motion of magnetic particles bound to a specific molecule, it is possible to let said molecule interact in a controlled way with other molecules in solution localized in different environments through which the particle is moved or with other molecules moved in turn by magnetic particles.

As a concrete example of application, it is possible to consider the synthesis of DNA sequences attached to a magnetic sphere moved in a sequential way through environments containing the different bases. The programmed movement of this sphere in a conduit properly designed with the appropriate bifurcations would allow the realization of said functionality.

An example of application of the system and method according to the present invention concerns the field of the preparation of biological samples for subsequent analysis such as the real time polymerase chain reaction (real time PCR). In this case, the preparation of the DNA sample to be amplified implies the employment of magnetic particles to separate the DNA molecules and purify the sample. This function is generally obtained by means of the manual intervention of an operator or of a robot employing test tubes and permanent magnets brought closer or further away from the test tubes in order to attract or release the magnetic particles bound to the DNA in the various phases in which the sample is put into contact with an appropriate reactant. The functionality of trapping, release and movement of magnetic particles by means of the structures shown according to the present invention, allow the integration of the preparation of a sample in a lab on a chip device. This would allow the elimination of an external phase of preparation of the sample in favour of the perspective of an analysis completely lab on a chip.

The invention claimed is:

1. Device for the manipulation of magnetic particles in suspension comprising:

a substrate;

a magnetic conduit suitable for the creation, movement and annihilation of domain walls, said magnetic conduit being placed on said substrate;

wherein said magnetic conduit comprises a strip of magnetic material so that magnetic particles in suspension can be, trapped, moved and released along said strip of magnetic material as a consequence of the creation, movement and annihilation of the domain walls along said strip of magnetic material and of the interaction between the domain walls and the magnetic particles, wherein the strip of magnetic material comprises a plurality of adjacent segments and the length of said segments is substantially larger than the transversal dimensions (width and thickness) of the plurality of adjacent segments so that the domain walls are constrained domain walls transversally placed with respect to the strip of magnetic material and maintain their integrity during the movement of the domain walls in an external magnetic field.

2. Device according to claim 1, wherein:

the thickness of each of said plurality of adjacent segments is 100 nm or less.

3. Device according to claim 1, wherein:

the width of each of said plurality of adjacent segments is 1 μm or less.

4. Device according to claim 1, wherein:

said strip of magnetic material forms a circular ring so that the movement of the magnetic particles along said strip of magnetic material is a continuous movement.

5. Device according to claim 1, wherein:

said strip of magnetic material is a ferromagnetic material at room temperature selected from the group consisting of permalloy, cobalt, iron, nickel, manganites, Fe304 and Heussler alloys.

6. Device for the manipulation of magnetic particles as in claim 1, further comprising:

means for the generation, movement and annihilation of domain walls in said magnetic conduit.

7. Device according to claim 6, wherein:

said means for the generation, movement and annihilation of domain walls comprise means for the creation of external fields.

8. Device according to claim 7, wherein:

said external fields comprise one of external magnetic field or external electromagnetic field.

9. Method for the manipulation of magnetic particles, comprising the following steps:

depositing the magnetic particles in suspension in proximity of the surface of a magnetic conduit suitable for the creation, movement and annihilation of domain walls and comprising a strip of magnetic material;

trapping at least one magnetic particle in the magnetic particles in suspension along said strip of magnetic material by creating at least a domain wall along said strip of magnetic material, wherein said strip of magnetic material comprises a plurality of adjacent segments and the length of said segments is substantially larger than the transversal dimensions (width and thickness) of said segments so that said domain wall is a constrained domain wall transversally placed with respect to said strip of magnetic material and maintains its integrity during the movement of the domain wall in an external magnetic field.

10. Method according to claim 9, further comprising the step of:

moving the at least one magnetic particle by moving the constrained domain wall along the strip of magnetic material.

11. Method according to claim 9, further comprising the step of:

releasing the at least one magnetic particle by annihilating the constrained domain wall along the strip of magnetic material.

* * * * *